US008475609B2

(12) United States Patent
Liu et al.

(10) Patent No.: US 8,475,609 B2
(45) Date of Patent: Jul. 2, 2013

(54) TREATING AL/ZN-BASED ALLOY COATED PRODUCTS

(75) Inventors: Qiyang Liu, Mount Keira (AU); Ross McDowall Smith, Cordeaux Heights (AU); Bryan Andrew Shedden, Albion Park (AU)

(73) Assignee: Bluescope Steel Limited, Melbourne (AU)

( * ) Notice: Subject to any disclaimer, the term of this patent is extended or adjusted under 35 U.S.C. 154(b) by 679 days.

(21) Appl. No.: 12/302,112

(22) PCT Filed: May 24, 2007

(86) PCT No.: PCT/AU2007/000711

§ 371 (c)(1),
(2), (4) Date: Dec. 22, 2008

(87) PCT Pub. No.: WO2007/134400

PCT Pub. Date: Nov. 29, 2007

(65) Prior Publication Data

US 2009/0199934 A1 Aug. 13, 2009

(30) Foreign Application Priority Data

May 24, 2006 (AU) ..... 2006902799

(51) Int. Cl.
*C23C 2/00* (2006.01)

(52) U.S. Cl.
USPC ..... 148/512; 148/516; 148/522; 148/533; 148/535; 148/537

(58) Field of Classification Search
USPC ..... 148/516, 522–531, 533, 535, 537, 148/903, 512; 427/372.2, 383.1
See application file for complete search history.

(56) References Cited

U.S. PATENT DOCUMENTS

| | | | | |
|---|---|---|---|---|
| 4,122,240 | A * | 10/1978 | Banas et al. | 428/655 |
| 4,157,923 | A | 6/1979 | Yen et al. | |
| 4,212,900 | A * | 7/1980 | Serlin | 148/241 |
| 4,287,008 | A | 9/1981 | Torok et al. | |
| 4,287,009 | A | 9/1981 | Allegra et al. | |
| 4,401,726 | A | 8/1983 | Gnanamuthu | |
| 5,547,769 | A | 8/1996 | Schmitz | |
| 6,231,695 | B1 | 5/2001 | Heiler et al. | |

FOREIGN PATENT DOCUMENTS

| | | |
|---|---|---|
| EP | 0710732 | 5/1996 |
| EP | 1518941 | 3/2005 |
| JP | 58141370 | 8/1983 |

OTHER PUBLICATIONS

Cui et al. "Laser surface remelting and resolidifying process of Zn-27 wt.% Al alloy." Materials Science and Engineering A323, 2002. pp. 103-109.*

Leonard, R. W. "Precoated Steel Sheet." Properties and Selection: Irons, Steels and High-Performance Alloys, vol. 1, ASM Handbook, ASM International, 1990. pp. 212-225.*

"Zinc Coatings" from the article "Zinc and Zinc Alloys." ASM Handbook. ASM International 2002.*

EP 07718957.9 Extended European Search Report dated Mar. 1, 2011 (9 pages).

PCT/AU2007/000711 International Search Report dated Jul. 30, 2007.

* cited by examiner

*Primary Examiner* — Steven Bos
*Assistant Examiner* — Brian Walck
(74) *Attorney, Agent, or Firm* — Michael Best & Friedrich LLP

(57) ABSTRACT

A method of treating an Al/Zn-based alloy coated product that includes an Al/Zn-based alloy coating on a substrate is disclosed. The method includes the steps of rapid intense heating of the alloy coating for a very short duration, and rapid cooling of the alloy coating, and forming a modified crystalline microstructure of the alloy coating.

42 Claims, 6 Drawing Sheets

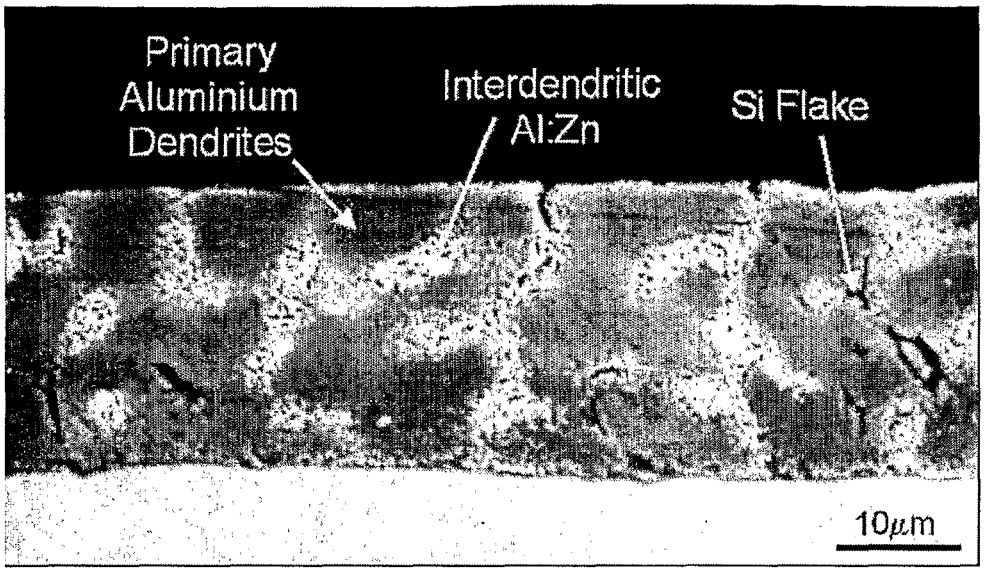
Figure 1: Example of conventional, untreated 55%Al-Zn based alloy coating.
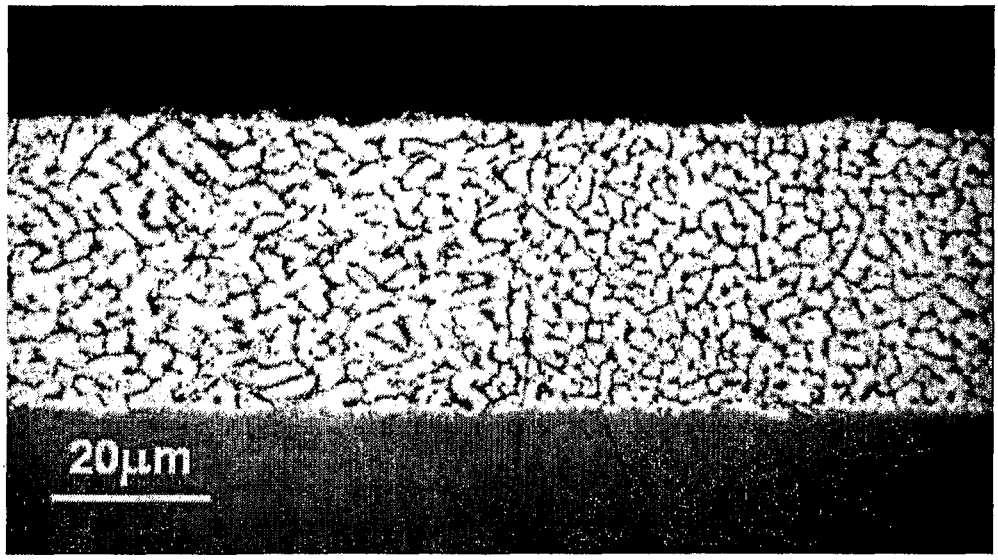
Figure 2: Example of treated 55%Al-Zn-based alloy coating with a very fine dendritic structure.

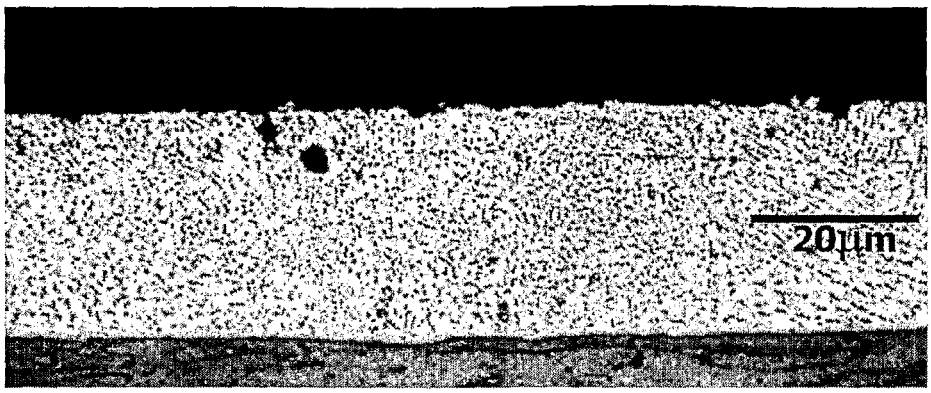
Figure 3: Example of Treated 55%Al-Zn-based alloy coating with fine zinc based particles uniformly distributed in an aluminium based matrix.
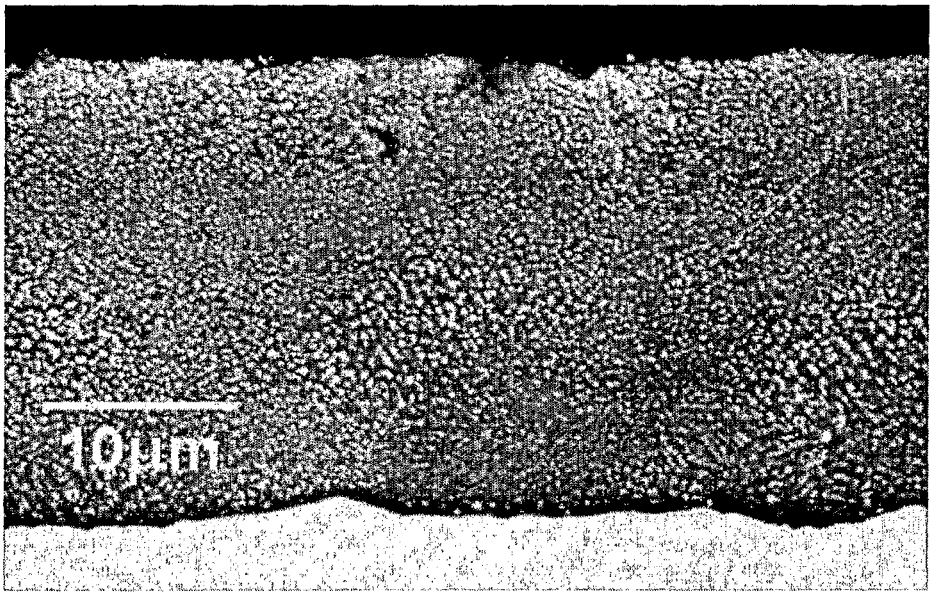
Figure 4: Example of Treated 55%Al-Zn-based alloy coating with fine zinc based particles uniformly distributed in an aluminium based matrix.

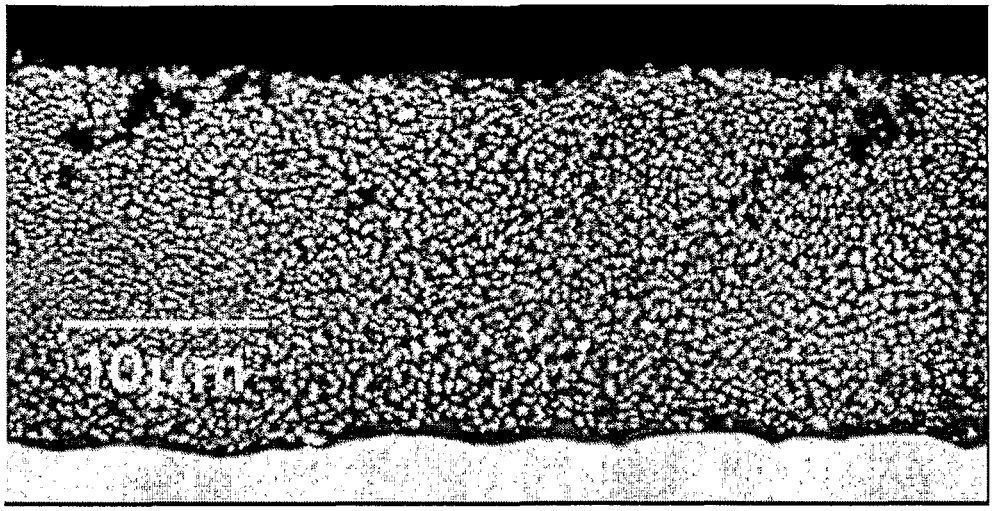
Figure 5: Example of Treated 55%Al-Zn-based alloy coating with fine zinc based particles uniformly distributed in an aluminium based matrix.
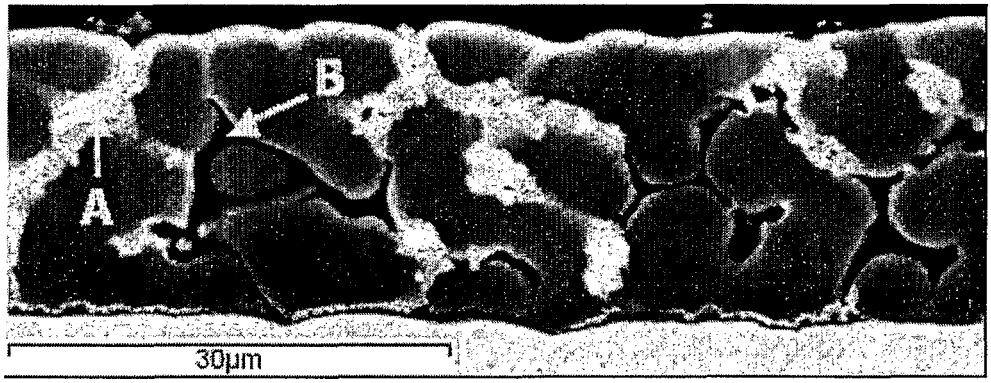
Figure 6: Example of conventional 55%Al-Zn based alloy containing extra elements and coarse Magnesium-containing InterMetallic Compound (IMC) particles (A&B).

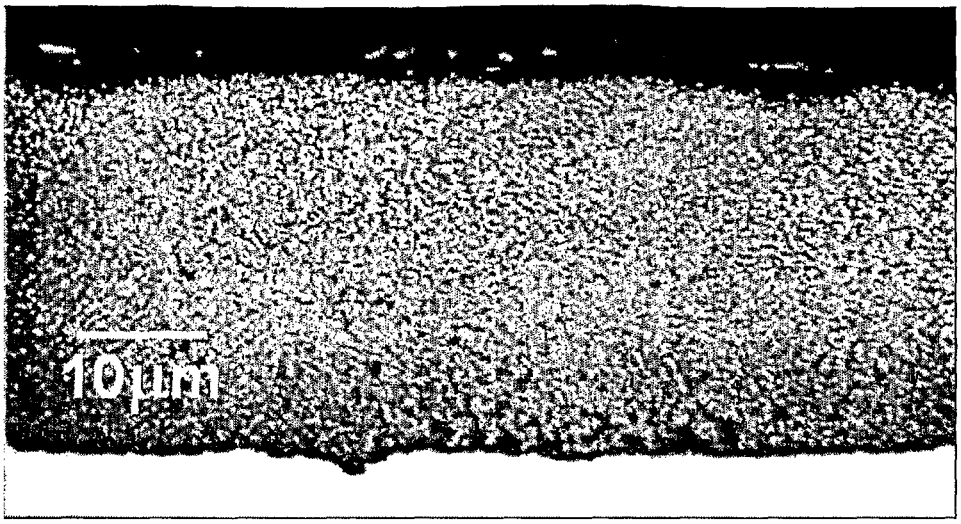

Figure 7: Example of treated coating from Figure 6 with a structure of very fine, uniformly dispersed particles of zinc rich phase and intermetallic compounds in an aluminium based matrix.

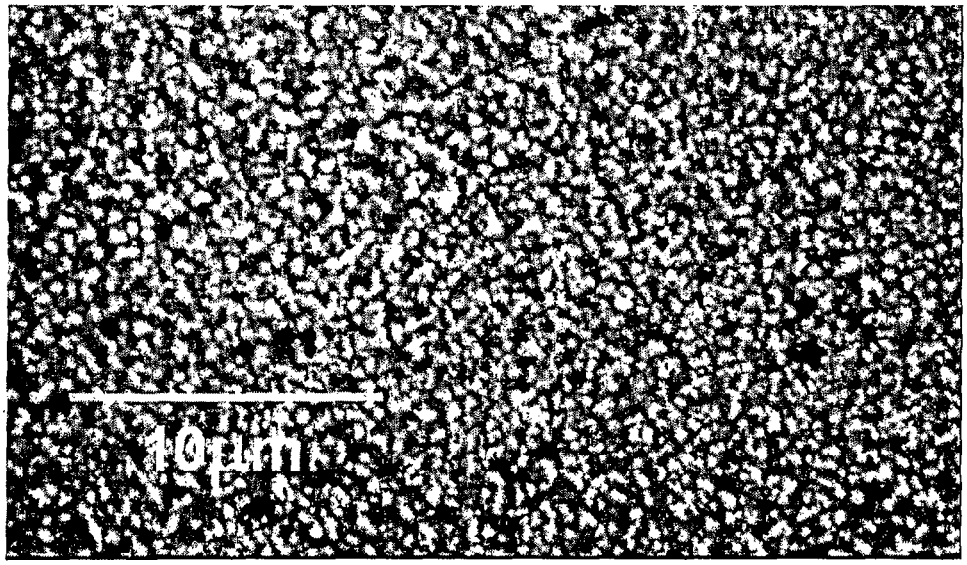

Figure 8: Example of treated coating from Figure 6 with a structure of very fine, uniformly dispersed particles of zinc rich phase and intermetallic compounds in an aluminium based matrix.

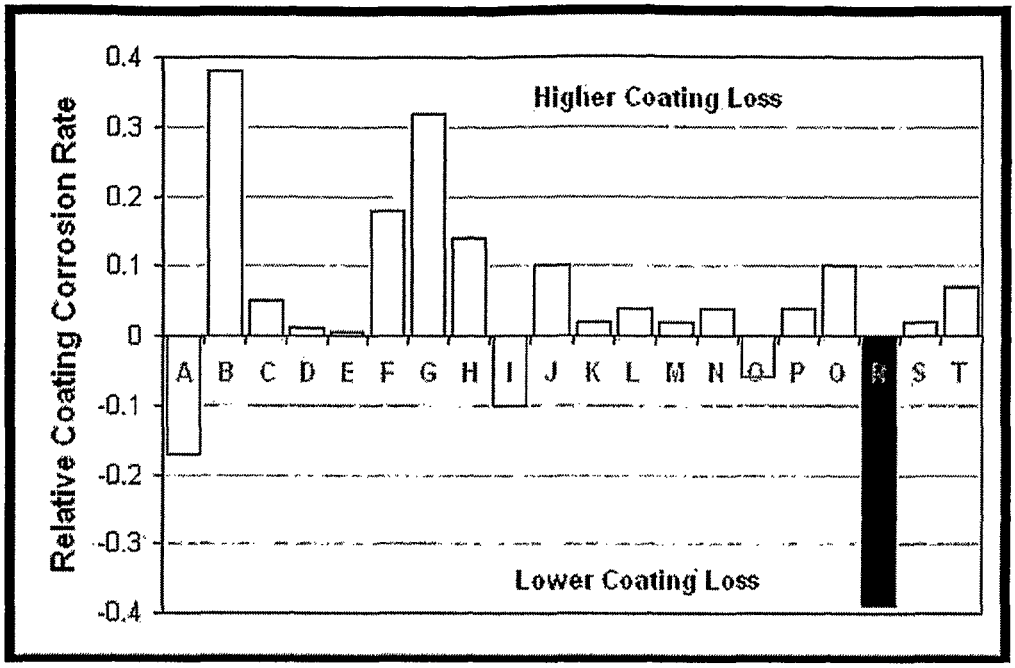
Figure 9: Impact of refined coating microstructure on corrosion performance compared to other coating alloy and process modifications.

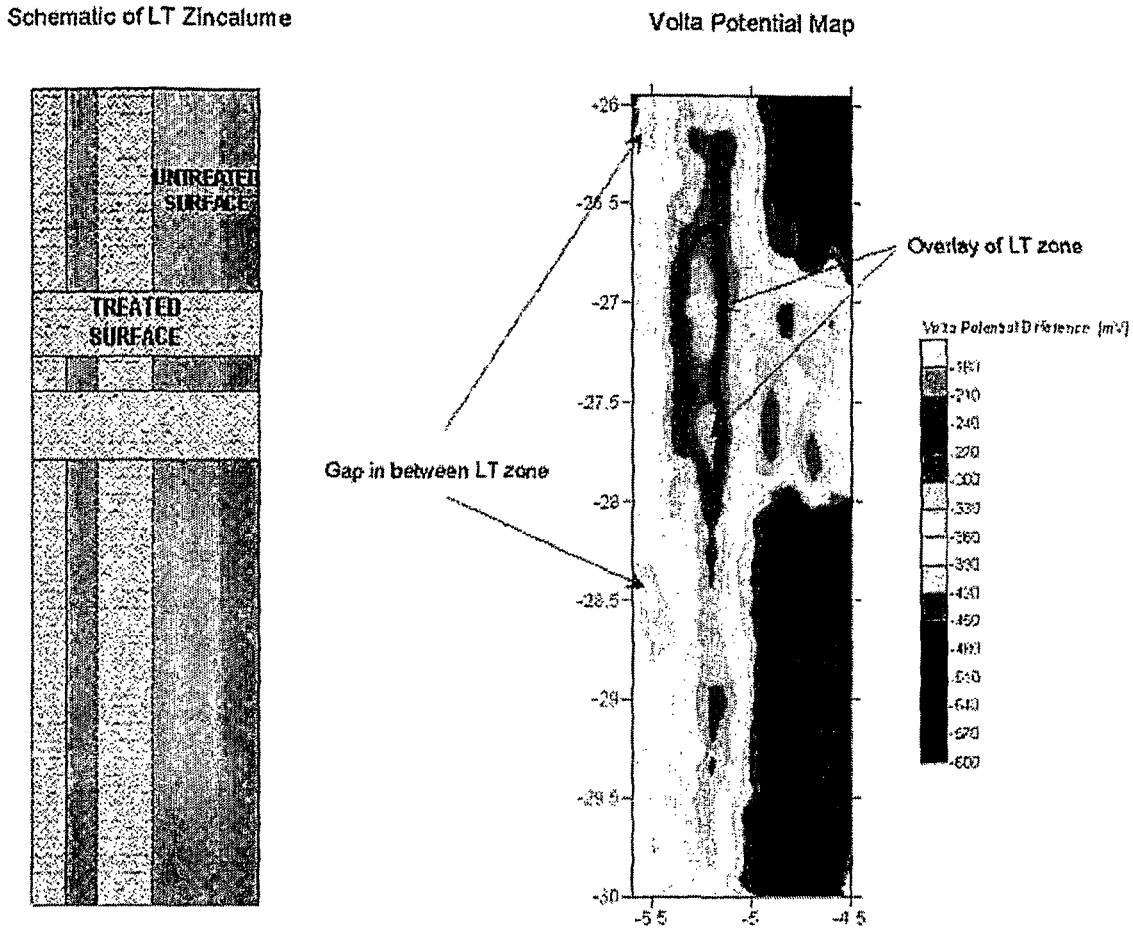
Figure 10: Enhanced corrosion resistance of a partially treated 55%Al-Zn based coating (Volta Plot).

TREATING AL/ZN-BASED ALLOY COATED PRODUCTS

TECHNICAL FIELD

The present invention relates generally to the production of products that have a coating of an alloy containing aluminium and zinc as the main components of the alloy (hereinafter referred to as "Al/Zn-based alloy coated products").

The term "Al/Zn-based alloy coated products" is understood herein to include products, by way of example, in the form of strip, tubes, and structural sections, that have a coating of an Al/Zn-based alloy on at least a part of the surface of the products.

The present invention relates more particularly to, although by no means exclusively to, Al/Zn-based alloy coated products in the form of steel strip and products made from Al/Zn-based alloy coated steel strip.

The Al/Zn-based alloy coated steel strip may be strip that is also coated with inorganic and/or organic compounds for protective, aesthetic or other reasons.

The present invention relates more particularly to, although by no means exclusively to, Al/Zn-based alloy coated steel strip that has a coating of an alloy of more than one element other that Al and Zn in more than trace amounts.

The present invention relates more particularly to, although by no means exclusively to, Al/Zn-based alloy coated steel strip that has a coating of an Al/Zn-based alloy containing 20-95% Al, 0-5% Si, balance Zn with unavoidable impurities. The coating may also contain 0-10% Mg and other elements in small amounts.

The present invention relates generally to a method of treating an Al/Zn-based alloy of a coating of a product to provide a modified crystalline microstructure based on a more homogenous mixture of the elements of the alloy coating composition.

BACKGROUND ART

Thin Al/Zn-based alloy coatings (2-100 μm) are often applied to the surfaces of steel strip to provide protection against atmospheric corrosion.

These alloy coatings are generally, but not exclusively, coatings of alloys of elements Al, Zn, Mg, Si, Fe, Mn, Ni, Sn and other elements such as V, Sr, Ca, Sb in small amounts.

These alloy coatings are generally, but not exclusively, applied to steel strip by hot dip coating strip by passing strip through a bath of molten alloy. The steel strip is typically, but not necessarily exclusively, heated prior to dipping to promote bonding of the alloy to the strip substrate. The alloy subsequently solidifies on the strip and forms a solidified alloy coating as the strip emerges from the molten bath.

The cooling rate of the alloy coating is relatively low, typically less than 100° C./s. The cooling rate is restricted by the thermal mass of the strip and by impact damage of the hot, soft coating by cooling media.

The low cooling rate means that the microstructure of the Al/Zn-based alloy is a relatively coarse dendritic and/or lamellar structure comprising a mixture of phases of different compositions.

Other known means of forming Al/Zn-based alloy coatings onto steel strip produce molten alloy coatings that solidify in different manners to hot-dip coatings. However, the Al/Zn-based alloys of the coatings still exist as relatively coarse mixtures of phases of different compositions.

SUMMARY OF INVENTION

The applicant has found that microstructures of Al/Zn-based alloy coatings on steel strip can be modified advantageously both structurally and chemically away from the above-described coarse, multiple phase microstructure by very rapid heating and thereafter very rapid cooling of the alloy coating.

In particular, the applicant has found that very rapid high intensity heating of Al/Zn-based alloy coated strip and very rapid cooling of the strip results in a modified microstructure, typically a microstructure that comprises a refined structure in which larger microstructural features have been reduced in size, or otherwise homogenized.

By way of theory or explanation, the applicant has found that very rapid heating of Al/Zn-based alloy coated strip makes it possible to confine heating to the alloy coating rather than to the substrate strip, allowing the substrate strip to act as a heat sink that facilitates very rapid cooling of the alloy coating, resulting in (a) retention of the homogenised microstructure of the coating alloy generated at elevated temperature or (b) transformation of the coating alloy to a very fine dendritic microstructure or (c) transformation of the coating alloy to other fine dispersed mixtures of phases.

According to the present invention there is provided a method of treating an Al/Zn-based alloy coated product that includes an Al/Zn-based alloy coating on a substrate, which method includes the steps of:

(a) rapid intense heating of the alloy coating for a very short duration, and (b) rapid cooling of the alloy coating, and forming a modified crystalline microstructure of the alloy coating.

According to the present invention there is also provided a method of treating an Al/Zn-based alloy coated product that includes an Al/Zn-based alloy coating on a substrate, which method includes the steps of:

(a) heating the alloy coating without significant heating of the substrate, and (b) very rapid cooling of the alloy coating by using the substrate as a heat sink, and forming a modified crystalline microstructure of the alloy coating.

The above-described method avoids or minimises the normal redistribution of elements that occurs during conventional solidification of Al/Zn-based alloy coatings at cooling rates typically less than 100° C./sec.

The modified crystalline microstructure may form in step (a) as a solid state change of an original microstructure of the alloy coating.

Alternatively, step (a) may cause at least partial melting of the Al/Zn-based alloy coating, and more preferably complete melting, whereby the modified crystalline microstructure forms when the alloy coating solidifies in step (b).

Preferably step (a) raises the temperature of the Al/Zn-based coating sufficiently high to allow dissolution of both fine and coarse particles of elements or compounds of elements that are in alloy coatings that conventionally solidify at cooling rates typically less than 100° C./s. This re-dissolution can occur even for high melting point compounds regardless of the short duration of the method.

The modified crystalline microstructure of the Al/Zn-based alloy coating may be a single phase.

For example, the single phase may be an Al-rich phase with Zn in solid solution.

The modified crystalline microstructure of the Al/Zn-based alloy coating may be a uniform dispersion of particles of one phase in another phase.

For example, the modified crystalline microstructure may be a uniform dispersion of fine particles of a Zn-rich phase in an Al-rich phase that forms a matrix of the coating alloy.

The modified crystalline microstructure of the Al/Zn-based alloy coating may be a uniform dispersion of fine primary dendrites of one phase and interdendritic regions of other phases.

For example, the modified crystalline microstructure may be a uniform dispersion of fine dendrites of an Al-rich phase and a Zn-rich interdendritic phase and other phases containing added elements with limited solubility in aluminium.

By way of example, for Al/Zn-based alloy coatings that undergo solidification by nucleation and growth of primary phase dendrites, the typical primary phase structural spacing is defined by the spacing of secondary dendrite arms. The present invention achieves secondary dendrite arm spacings less than 5 um and more beneficially, less than 2 um compared to secondary dendrite arm spacings typically around 10-15 um for structures conventionally solidified at rates normally less than 100° C./s.

Preferably step (a) includes very rapidly heating the Al/Zn-based alloy coating.

Preferably step (a) includes heating the Al/Zn-based alloy coating at a heating rate of at least 500° C./s, more preferably at least 10,000° C./s.

Preferably step (a) includes a heating duration of less than 200 milliseconds, more preferably less than 20 milliseconds, and more preferably less than 2 milliseconds.

The applicant has found that the above-described heating of Al/Zn-based alloy coatings can be achieved without significantly raising the temperature of the underlying substrate by using high power density heating sources and that the relatively cool substrate assists attainment of the required very high cooling rates.

The term "high power density heating sources" is understood herein to include, by way of example, laser, direct plasma, indirect high density plasma arc lamps and conventional filament-based Near Infrared (NIR) systems. In order to achieve the required heating rate, required temperature and thickness temperature distribution, it is necessary to use a heat source emitting a power density greater than 70 $W/mm^2$, and more preferably greater than 300 $W/mm^2$.

Step (a) may include heating the Al/Zn-based alloy coating from a temperature above ambient. For example, in a case of treating an Al/Zn-based alloy coated product in the form of an Al/Zn-based alloy coated steel strip produced in a hot dip coating line, using the hot Al/Zn-based alloy coated steel strip as a feed to step (a) minimises total energy consumption and still maintains the necessary cooling rate to ensure that the intended Al/Zn-based alloy coating microstructure and integrity are produced.

The incoming strip temperature to step (a) is preferably less than 300° C. and more preferably less than 250° C.

The method may be applied to both surfaces simultaneously or to each surface separately. To minimise softening of the Al/Zn-based alloy coating on the side opposite that being treated by the method at any given point in time, and to enhance the cooling rate, the reverse surface may be maintained at a fixed temperature, preferably less than 300° C., and more preferably less than 250° C.

Preferably step (a) includes heating the alloy coating to a temperature in the range 250-910° C., more preferably in the range 380-800° C., and more preferably in the range 450-800° C.

Preferably step (a) includes heating the Al/Zn-based alloy coating to a temperature and/or for a time selected so that there is minimal growth of an intermetallic alloy layer at an interface of the alloy coating and the substrate.

Preferably the intermetallic alloy layer is maintained within a range of 0-5 μm, preferably 0-3 μm, and more preferably 0-1 μm.

Preferably step (a) includes heating the Al/Zn-based alloy coating while ensuring that the substrate is at a sufficiently low temperature to prevent recrystallisation of a recovery annealed substrate or phase changes in the substrate which would be detrimental to the substrate properties.

After heating the Al/Zn-based alloy coating in step (a), the relatively cold substrate extracts heat from the alloy coating in step (b), the substrate acting as a heat sink and causing extremely high cooling rates in the alloy coating that retain or form the modified crystalline microstructure.

The term "very rapid cooling" is understood herein to mean cooling at a rate that minimises the redistribution of elements from the homogeneous molten Al/Zn-based alloy coating or the homogenised single phase structure in a solid state or at a rate that allows controlled solidification of the molten form of the alloy coating.

The cooling rate required is at least 100° C./s, preferably at least 500° C./s, and more preferably at least 2000° C./s.

The applicant has identified processing conditions suitable for substrates in the form of thick steel strip (up to 5 mm) and also for substrates in the form of very thin steel strip which would normally provide a smaller heat sink.

Where the heating rate is low, the required temperature of the substrate is higher and step (b) may include forced cooling to retain the desired, modified microstructure.

The level of forced cooling required to retain the modified crystalline microstructure is lower than for conventional processing, as cooling is also achieved from the colder substrate. The extent of forced cooling required can be achieved without disrupting the surface of the alloy coating.

According to the present invention there is provided a Al/Zn-based alloy coated product treated in accordance with the above-described method.

According to the present invention there is provided a method of producing an Al/Zn-based alloy coated product that includes the steps of hot dip coating a substrate in the form of a steel strip with an Al/Zn-based alloy and treating the coated steel strip in accordance with the above-described treatment method.

The method may be carried out in-line, with the treatment method being carried out immediately after hot dip coating the substrate.

Alternatively, the method may be carried out on separate lines, with the treatment method being carried out on coiled strip produced by hot dip coating the substrate.

BRIEF DESCRIPTION OF THE DRAWINGS

The present invention is described further by way of example with reference to:

FIGS. 1-8 which are photomicrographs of samples tested in experimental work in relation to the above-described method of the present invention carried out by the applicant;

FIG. 9 is a graph reporting the results of corrosion testwork on samples tested in the experimental work; and FIG. 10 is a Volta Potential Map of a sample tested in the experimental work.

EXAMPLES

The experimental work was carried out on test samples of steel strip that were hot-dip coated with Al/Zn-based alloys. The experimental work included heating the alloy coatings of the samples by a high power density heating source in the form of a laser and by Near Infrared Radiation (NIR) and thereafter cooling the alloy coatings.

An example of the microstructure of a conventional hot-dip Al/Zn alloy-based coated steel strip is shown in FIG. 1. The microstructure predominantly comprises two separate phases, namely an Al-rich dendritic phase and a Zn-rich interdendritic mixture of phases. The microstructure also comprises a small number of coarse silicon particles.

The alloy coatings of the samples were heated rapidly in a range of different thermal profiles—temperatures and hold times—and were thereafter cooled rapidly in accordance with the method of the present invention.

For alloy coatings containing significant amounts of Al and Zn, the coating microstructure after rapid heating and rapid cooling in accordance with the method of the present invention comprised a primary matrix of a predominantly Al phase and a fine, uniform dispersion of a secondary Zn-rich phase.

Depending on the heating and cooling conditions, the secondary Zn-rich phase comprised (a) interconnected zones of interdendritic mixtures of Zn-rich phases or (b) discrete Zn-rich particles of a size less than 5 μm, ideally less than 2 μm, and more ideally less than 0.5 μm.

An example of the interdendritic mixtures of Zn-rich phases is shown in FIG. 2. Examples of the Zn-rich particles are shown in FIGS. 3, 4, and 5.

An example of the microstructure of a conventional hot-dip Al/Zn alloy-based coated steel strip in which the coating alloy contains Si is shown in FIG. 6. The Si is present in the microstructure in the form of relatively coarse needle-shaped particles or as coarse intermetallic compound particles (for example when Mg is also present in the coating alloy—see the zone identified by the arrow B in FIG. 6).

The applicant found in the experimental work that, after treatment by the method of the present invention, the Si in an Al/Zn coating alloy containing Si is advantageously in the form of fine discrete particles of Si or Si intermetallic compounds (for example when Mg is also present in the coating alloy) and/or as atoms in the primary matrix—see FIGS. 7 and 8.

The applicant found in the experimental work that other intermetallic compounds of elements, for example Mg and Zn, that are typically in Al/Zn-based coating alloys as very coarse particles that are detrimental to corrosion of the coating and formability of the coating, are also refined by the treatment method of the present invention and are distributed throughout the alloy coating as uniform dispersions of fine particles. The arrow A in FIG. 6 shows a very coarse intermetallic particle of Mg and Zn in an untreated coating alloy. FIGS. 7 and 8 show treated coatings.

The applicant determined by elemental analysis that the compositions of Al/Zn-based alloy coatings, which may contain other elements such as, for example, Si and Mg to enhance performance, are not altered by the treatment method.

ADVANTAGES

The applicant found by electrochemical testing, accelerated corrosion testing, and long term atmospheric exposure testing that the modified crystalline microstructure produced by the method of the present invention is more corrosion resistant than conventionally manufactured, coarse microstructure, Al/Zn-based alloy coated steel strip. The results of the corrosion test work are shown in FIG. 9. Sample "R" in FIG. 9 is a sample treated in accordance with the method of the present invention. The other samples are conventionally produced samples.

The applicant found that corrosion resistance is enhanced by reducing the size and continuity of the more freely corroding phases, for example, phases rich in zinc and/or magnesium, or other reactive elements.

The improvement in surface corrosion performance of Al/Zn alloy-based coating treated by the method of the present invention is demonstrated by a Volta Potential Map shown in FIG. 10. The left-hand side of the Figure comprises a top plan of a sample comprising an Al/Zn-based coating alloy, with some sections treated by the method of the present invention and other sections untreated. The right-side of the Figure comprises a Volta Potential Map of the sample.

The applicant determined that in Al/Zn alloy-based coatings containing, for example, Mg and Si, surface corrosion may proceed rapidly along coarse InterMetallic Compound (IMC) particles of Mg-containing compounds. The applicant found that such large particles are refined by the treatment method of the present invention and the corrosion pathways are eliminated.

The corrosion performance of conventionally produced Al/Zn-based alloy coatings manufactured by the hot-dip process or other thermal process, degrades significantly when the thickness of the coating approaches the coarseness of the microstructure, for example, 5-10 μm, due to well-defined corrosion pathways. The applicant found that such corrosion pathways are eliminated in the modified crystalline microstructure produced by the treatment method of the present invention.

The applicant found by accelerated corrosion testing, and long term atmospheric exposure testing, that the modified crystalline microstructure produced by the treatment method of the present invention is also more corrosion resistant when the Al/Zn-based alloy coated steel strip has been subsequently coated with combinations of inorganic compounds and/or organic based polymers.

The corrosion of painted, Al/Zn-based alloy coated steel strip generally proceeds more rapidly from the edges of the strip or perforations in the strip. The applicant found that corrosion from the edges of the painted, Al/Zn-based alloy coated steel strip can be reduced by forming the modified crystalline microstructure produced by the treatment method of the present invention in (a) a narrow band of the alloy coating at the edge of the strip and/or (b) in a variety of regular or irregular patterns across the strip surface without forming the modified crystalline microstructure in the entire alloy coating over the complete strip surface.

Partial benefits can also be obtained by partially treating a proportion of the Al/Zn-based alloy coating. The steel strip can be treated on both surfaces or only one surface, at the same time or sequentially.

The applicant determined that coarse particles of elements and intermetallic compounds that are known to be detrimental to Al—Zn based alloy coating ductility have been eliminated.

Many modifications may be made to the present invention described above without departing from the spirit and scope of the invention.

The invention claimed is:

1. A method of treating an Al/Zn-based alloy coated product that includes an Al/Zn-based alloy coating of 2-100 μm thickness on a steel strip to enhance the corrosion resistance of the coating, which method includes the steps of:

(a) heating the alloy coating at a heating rate of at least 500° C./s for less than 200 milliseconds, and (b) cooling the alloy coating at a cooling rate of at least 100° C./s, and forming a modified crystalline microstructure of the alloy coating.

2. The method defined in claim 1 wherein the modified crystalline microstructure forms in step (a) as a solid state change of an original microstructure of the alloy coating.

3. The method defined in claim 1 wherein step (a) comprises at least partially melting the Al/Zn-based alloy coating, whereby the modified crystalline microstructure forms when the alloy coating solidifies in step (b).

4. The method defined in claim 3 wherein step (a) comprises completely melting the Al/Zn-based alloy coating, whereby the modified crystalline microstructure forms when the alloy coating solidifies in step (b).

5. The method defined in claim 1 wherein step (a) comprises raising the temperature of the Al/Zn-based coating sufficiently high to allow dissolution of both fine and coarse particles of elements or compounds of elements that are in alloy coatings that solidify at cooling rates less than 100° C./s.

6. The method defined in claim 1 wherein the modified crystalline microstructure of the Al/Zn-based alloy coating is a single phase.

7. The method defined in claim 1 wherein the modified crystalline microstructure of the Al/Zn-based alloy coating is a uniform dispersion of particles of one phase in another phase.

8. The method defined in claim 1 wherein the modified crystalline microstructure of the Al/Zn-based alloy coating is a uniform dispersion of fine primary dendrites of one phase and interdendritic regions of other phases.

9. The method defined in claim 1 wherein step (a) includes heating the Al/Zn-based alloy coating at a heating rate of at least 10,000° C./s.

10. The method defined in claim 1 wherein step (a) includes a heating duration of less than 20 milliseconds.

11. The method defined in claim 1 wherein step (a) includes heating the Al/Zn-based alloy coating from a temperature above an ambient temperature.

12. The method defined in claim 1 wherein step (a) includes heating the alloy coating to a temperature in the range 250-910° C.

13. The method defined in claim 1 wherein step (a) includes heating the Al/Zn-based alloy coating to a temperature and/or for a time selected so that there is minimal growth of an intermetallic alloy layer at an interface of the alloy coating and the steel strip.

14. The method defined in claim 13 wherein the intermetallic alloy layer is maintained within a range of 0-5 μm.

15. The method defined in claim 1 wherein step (a) includes heating the Al/Zn-based alloy coating while ensuring that the steel strip is at a sufficiently low temperature to prevent recrystallisation of a recovery annealed steel strip or phase changes in the steel strip.

16. The method defined in claim 1 wherein, after heating the Al/Zn-based alloy coating in step (a), the steel strip extracts heat from the alloy coating in step (b), the steel strip acting as a heat sink and causing the cooling rate of at least 100° C./s in the alloy coating that retains or forms the modified crystalline microstructure.

17. The method defined in claim 16 wherein the cooling rate is at least 500° C./s.

18. A method of producing an Al/Zn-based alloy coated product that includes the steps of hot dip coating a substrate in the form of a steel strip with an Al/Zn-based alloy and treating the coated steel strip in accordance with the method defined in claim 1.

19. The method defined in claim 1 wherein step (a) includes heating the alloy coating to a temperature in the range 380-800° C.

20. The method defined in claim 1 wherein step (a) includes heating the alloy coating to a temperature in the range 450-800° C.

21. The method defined in claim 13 wherein the intermetallic alloy layer is maintained within a range of 0-3 μm.

22. The method defined in claim 13 wherein the intermetallic alloy layer is maintained within a range of 0-1 μm.

23. The method defined in claim 16 wherein the cooling rate is at least 2000° C./s.

24. The method defined in claim 1 wherein the Al/Zn-based alloy is a 55% Al—Zn based alloy.

25. A method of treating an Al/Zn-based alloy coated product that includes an Al/Zn-based alloy coating of 2-100 μm thickness on a steel strip to enhance the corrosion resistance of the coating, which method includes the steps of:

(a) heating the alloy coating without heating the steel strip, and (b) cooling the alloy coating at a cooling rate of at least 100° C./s by using the steel strip as a heat sink, and forming a modified crystalline microstructure of the alloy coating.

26. The method defined in claim 25 wherein the modified crystalline microstructure forms in step (a) as a solid state change of an original microstructure of the alloy coating.

27. The method defined in claim 25 wherein step (a) comprises at least partially melting the Al/Zn-based alloy coating, whereby the modified crystalline microstructure forms when the alloy coating solidifies in step (b).

28. The method defined in claim 25 wherein step (a) comprises raising the temperature of the Al/Zn-based coating sufficiently high to allow dissolution of both fine and coarse particles of elements or compounds of elements that are in alloy coatings that solidify at cooling rates less than 100° C./s.

29. The method defined in claim 25 wherein the modified crystalline microstructure of the Al/Zn-based alloy coating is a single phase.

30. The method defined in claim 25 wherein the modified crystalline microstructure of the Al/Zn-based alloy coating is a uniform dispersion of particles of one phase in another phase.

31. The method defined in claim 25 wherein the modified crystalline microstructure of the Al/Zn-based alloy coating is a uniform dispersion of fine primary dendrites of one phase and interdendritic regions of other phases.

32. The method defined in claim 25 wherein step (a) includes heating the Al/Zn-based alloy coating at a heating rate of at least 10,000° C./s.

33. The method defined in claim 25 wherein step (a) includes a heating duration of less than 20 milliseconds.

34. The method defined in claim 25 wherein step (a) includes heating the Al/Zn-based alloy coating from a temperature above an ambient temperature.

35. The method defined in claim 25 wherein step (a) includes heating the alloy coating to a temperature in the range 250-910° C.

36. The method defined in claim 25 wherein step (a) includes heating the Al/Zn-based alloy coating to a temperature and/or for a time selected so that there is minimal growth of an intermetallic alloy layer at an interface of the alloy coating and the steel strip.

37. The method defined in claim 25 wherein step (a) includes heating the Al/Zn-based alloy coating while ensuring that the steel strip is at a sufficiently low temperature to prevent recrystallisation of a recovery annealed steel strip or phase changes in the steel strip.

38. The method defined in claim 25 wherein, after heating the Al/Zn-based alloy coating in step (a), the steel strip extracts heat from the alloy coating in step (b), the steel strip acting as a heat sink and causing the cooling rate of at least 100° C./s in the alloy coating that retains or forms the modified crystalline microstructure.

39. A method of producing an Al/Zn-based alloy coated product that includes the steps of hot dip coating a substrate in the form of a steel strip with an Al/Zn-based alloy and treating the coated steel strip in accordance with the method defined in claim 25.

40. The method defined in claim 25 wherein step (a) includes heating the alloy coating to a temperature in the range 380-800° C.

41. The method defined in claim 25 wherein step (a) includes heating the alloy coating to a temperature in the range 450-800° C.

42. The method defined in claim 25 wherein the Al/Zn-based alloy is a 55% Al—Zn based alloy.

* * * * *

UNITED STATES PATENT AND TRADEMARK OFFICE

CERTIFICATE OF CORRECTION

PATENT NO. : 8,475,609 B2
APPLICATION NO. : 12/302112
DATED : July 2, 2013
INVENTOR(S) : Liu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 795 days.

Signed and Sealed this
Eighth Day of September, 2015

Michelle K. Lee

Michelle K. Lee
*Director of the United States Patent and Trademark Office*